US006111555A

United States Patent [19]

Haas

[11] Patent Number: 6,111,555

[45] Date of Patent: Aug. 29, 2000

[54] SYSTEM AND METHOD FOR DRIVING A FLAT PANEL DISPLAY AND ASSOCIATED DRIVER CIRCUIT

[75] Inventor: Andrew M. Haas, Perrysburg, Ohio

[73] Assignee: Photonics Systems, Inc., Northwood, Ohio

[21] Appl. No.: 09/022,515

[22] Filed: Feb. 12, 1998

[51] Int. Cl.[7] ..... G09G 3/20

[52] U.S. Cl. ..... 345/60; 345/63; 345/68

[58] Field of Search ..... 345/60, 55, 50, 345/51, 67, 87, 98, 100, 103, 95, 93, 63, 68

[56] References Cited

U.S. PATENT DOCUMENTS

| | | | |
|---|---|---|---|
| 5,081,400 | 1/1992 | Weber et al. . | |
| 5,307,084 | 4/1994 | Yamaguchi et al. | 345/87 |
| 5,359,343 | 10/1994 | Nakamura | 345/100 |
| 5,438,290 | 8/1995 | Tanaka . | |
| 5,546,102 | 8/1996 | Sheffer et al. | 345/100 |
| 5,654,728 | 8/1997 | Kanazawa et al. . | |
| 5,864,328 | 1/1999 | Kajimoto | 345/95 |

OTHER PUBLICATIONS

S. Mikoshiba, "Seminars M4: Color Plasma Displays," Society for Information Display (SID), 1997.

S. Mikoshiba, Society for Information Display, "Color Plasma Displays", Seminars M–4, The University of Electro–Communications, Tokyo, Japan "Afix all types of . . . ," Jan. 1.

*Primary Examiner*—Steven J. Saras
*Assistant Examiner*—Alech D. Nelson
*Attorney, Agent, or Firm*—Marshall & Melhorn

[57] ABSTRACT

A system and method for driving a flat panel display are provided. The system includes a register connected to a latch having outputs connected to logic circuits which correspond to the electrodes. Each logic circuit is also connected to the register, and generates control signals based on the next state and the current state of the corresponding electrode. Each logic circuit is configured such that upon an activation signal, the logic circuit control signals connect the change up driver to electrodes having a low current state and a high next state, and connect the change down driver to electrodes having a high current state and a low next state.

6 Claims, 6 Drawing Sheets

SYSTEM AND METHOD FOR DRIVING A FLAT PANEL DISPLAY AND ASSOCIATED DRIVER CIRCUIT

TECHNICAL FIELD

The present invention relates to systems and methods for driving flat panel displays and associated driver circuits.

BACKGROUND ART

Plasma display panels are currently expected to replace cathode ray tubes for many uses such as televisions, monitors, and other video displays. One important advantage of plasma display panels is that a relatively large display area can be provided with relatively minimal thickness as compared to cathode ray tubes.

The general construction of plasma display panels includes generally sheet-like front and back glass substrates having inner surfaces that oppose each other with a chemically stable gas hermetically sealed therebetween by a seal between the substrates at the periphery of the panel. Elongated electrodes covered by a dielectric layer are provided on both substrates with the electrodes on the front glass substrate extending transversely to the electrodes on the back glass substrate so as to thereby define gas discharge cells or pixels that can be selectively illuminated by an electrical driver of the plasma display panel. The panels can be provided with phosphors to enhance the luminescence and thus also the efficiency of the panels. The phosphors can also be arranged in pixels having several subpixels for respectively emitting the primary colors red, green, and blue to provide a full color plasma display panel.

In plasma display panels, it is becoming increasingly desirable to have larger display screens with more display lines and more intensity levels, with minimal power consumption. Known driving techniques for both color and monochrome alternating current plasma display panels include addressing periods in which charge quantities are retained by selected pixels, and sustain periods during which the charge quantities are excited to illuminate the selected pixels. During the sustain periods, the plasma display panel is driven by a bulk sustaining function which applies a uniform voltage waveform to the entire plasma display panel. The bulk sustained voltages are generated by an electrical circuit designed specifically for this purpose. During the addressing periods, individual row and column electrodes of the plasma display panel are selectably driven with voltages unique to the current image content of the plasma display panel. Selective address voltages are generated by driver integrated circuits which are specifically designed for direct connection to the plasma display panel electrodes.

As plasma display panels increase in size, number of display lines, and number of intensity levels, the power requirements of the driver circuits also increase. Energy recovery circuits are employed in plasma display panels to help reduce power consumption. Existing energy recovery circuits are used with bulk sustain electrode pairs in which two pulse generators provide sustained pulses with waveforms 180° out of phase to each other. For example, U.S. Pat. No. 5,654,728 issued to Kanazawa et al. discloses bulk driver energy recovery circuits.

A primary disadvantage associated with existing driving techniques is the fact that the column or data electrode driver circuits are responsible for a very significant amount of the overall plasma display panel power consumption. This is because the data electrode driver outputs pulse at a much higher frequency than the bulk sustain driver outputs.

SUMMARY OF THE INVENTION

It is, therefore, an object of the present invention to provide a system and method for driving a flat panel display which utilizes energy efficient driving techniques for the data electrodes.

It is another object of the present invention to provide a display driver circuit for a flat panel display which is versatile enough to be used for a variety of applications, and capable of energy efficient data electrode driving in a plasma display panel.

In carrying out the above objects and other objects and features of the present invention, a system for driving a flat panel display having display pixels at cross-points of scan electrodes and data electrodes is provided. The system comprises a register capable of storing display bits, and a latch connected to the register and having outputs. Each register bit represents a next state for a corresponding electrode. Each latch output represents a current state for a corresponding electrode. The system further comprises logic circuits and driver circuitry. Each logic circuit corresponds to a electrode. Each logic circuit produces control signals based on the next state and the current state of the corresponding electrode. The driver circuitry includes a change up driver and a change down driver. Each electrode is selectively connectable to the driver circuitry by the corresponding logic circuit control signals.

Each logic circuit is configured such that upon an activation signal, the logic circuit control signals connect the change up driver to electrodes having a low current state and a high next state. Further, the logic circuit control signals connect the change down driver to electrodes having a high current state and a low next state.

In a preferred embodiment, each logic circuit further includes a first input connected to the corresponding register bit, and a second input connected to the corresponding latch output. A combinational logic network receives the first and second inputs, and generates the plurality of control signals. The plurality of control signals include a change up control signal for selectively connecting the change up driver to the corresponding electrode, and a change down control signal for selectively connecting the change down driver to the corresponding electrode. The combinational logic network is configured such that upon the activation signal, the change up control signal is asserted when the corresponding electrode has a low current state and a high next state. The change down control signal is asserted when the corresponding electrode has a high current state and a low next state.

Further, in a preferred embodiment, the plurality of control signals include a hold up control signal and a hold down control signal. The combinational logic network asserts the hold up control signal upon the actuation signal when the corresponding electrode has a high current state and a high next state. The combinational logic network asserts the hold down control signal upon the actuation signal when the corresponding electrode has a low current state and a low next state. The asserted hold up control signal connects the corresponding electrode to a hold up voltage source; the asserted hold down control signal connects the corresponding electrode to a hold down voltage source.

Further, in a preferred embodiment, the system further comprises a plurality of change up switch elements and a plurality of change down switch elements. Each change up switch element has an input connected to the change up control signal of a corresponding logic circuit, a first terminal connected to the change up driver, and a second terminal connected to the corresponding electrode. Each change down switch element has an input connected to the change down control signal of the corresponding logic circuit, a first terminal connected to the change down driver, and a second terminal connected to the corresponding electrode.

Further, in carrying out the present invention, a display driver circuit for a flat panel display is provided. The driver circuit comprises a register, a latch, logic circuits corresponding to the electrodes, and change up and change down switch elements.

Further, in carrying out the present invention, a plasma display panel including a pair of substrates positioned to define a gap region therebetween is provided. electrodes disposed in the gap region form display lines composed of pixels. The plasma display panel includes a driver system made in accordance with the present invention.

Still further, in carrying out the present invention, a method of driving a flat panel display is provided. The method comprises determining a current state for each electrode, determining a next state for each electrode, generating a plurality of control signals for each electrode based on the next state and the current state for that electrode, and selectively connecting driver circuitry to each electrode based on the control signals for that electrode.

The advantages accruing to the present invention are numerous. For example, the present invention provides a system and method for driving a flat panel display and an associated driver circuit which is versatile enough to be used for a variety of electrode groups, and capable of energy efficient electrode driving.

The above objects and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
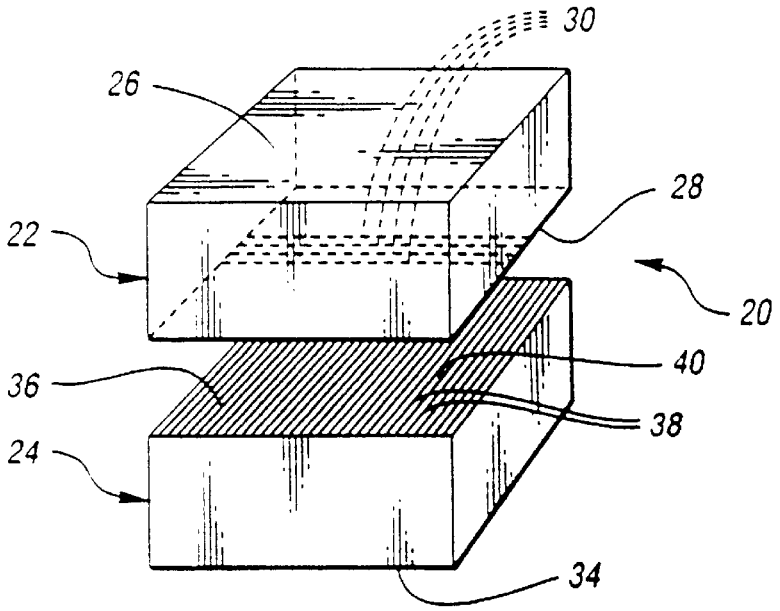
FIG. 1 is an exploded perspective view that is somewhat schematic to illustrate the active area of a plasma display panel constructed in accordance with the present invention.
Figure 2:
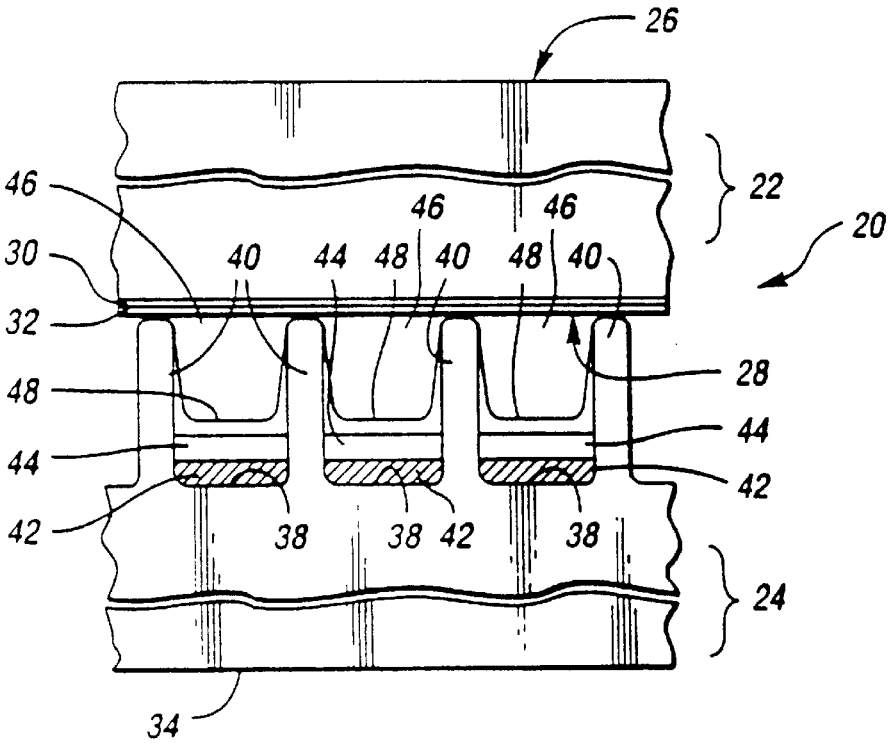
FIG. 2 is a partially broken away sectional view taken through the plasma display panel of FIG. 1 to illustrate its construction.

With reference to the somewhat schematic view of FIG. 1 of the drawings, an alternating current plasma display panel constructed in accordance with the invention is generally indicated at 20. The plasma display panel 20 includes a generally sheet-like front glass substrate 22 and a generally sheet-like back glass substrate 24. The front glass substrate 22 has an outer surface 26 that faces forwardly during use toward the viewer of the display. The front glass substrate 22 also includes an inner surface 28 that faces rearwardly during use and includes elongated electrodes 30 over its extent with only several of these being illustrated by schematic hidden line representation. These electrodes 30, as illustrated in FIG. 2, are covered by a dielectric layer 32. The electrodes 30 extend in a spaced and parallel relationship to each other in a first direction generally between opposite extremities of the display panel 20 where suitable electrical connections are made to an electrical driver which will be described. Although the front and back glass substrates 22 and 24 for ease of illustration are shown somewhat block shaped, they actually have sheet-like shapes with relatively large dimensions between their opposite extremities and relatively thin thicknesses.

With continuing reference to FIG. 1 and additional reference to FIG. 2, the back glass substrate 24 of the plasma display panel 20 includes an outer surface 34 that faces rearwardly during use of the panel away from the observer and also includes an inner surface 36 that faces forwardly in an opposed relationship to the inner surface 28 of the front glass substrate 22. This inner surface 36 of the back glass substrate 24, as illustrated in FIG. 2, includes gas discharge troughs 38 and also includes barrier ribs 40 that space the gas discharge troughs from each other.

These gas discharge troughs 38 and barrier ribs 40 are elongated, as schematically illustrated in FIG. 1, extending in a spaced and parallel relationship to each other in a second direction that is transverse to the first direction of the electrodes 30 of the front glass substrate 22. The back glass substrate 24 includes elongated electrodes 42 within the gas discharge troughs 38 and each of these electrodes is covered by a dielectric layer 44 that may be covered with an unshown thin layer of magnesium oxide or other suitable secondary emissive thin film that lowers the required operating voltages. The electrodes 42 of the back glass substrate extend to at least one extremity of the display panel 20 for connection with an electrical driver of the panel. Gas discharge cells or pixels 46 are provided at cross-points of the front electrodes 30 and back electrodes 42. A chemically stable gas is hermetically sealed by a seal between the peripheries of the front and back glass substrates 22 and 24. For color displays, an addition of Helium, Neon, or Argon to Xenon has been found to lower the breakdown voltage.

As illustrated in FIG. 2, the gas discharge troughs 38 may also have phosphors 48 that enhance the luminescence and also can be arranged in pixels having adjacent gas discharge troughs providing subpixels for emitting the three primary colors red, green, and blue to provide a full color display. In the latter case, the pitch of the spacing between the gas discharge troughs 38 should be approximately one-third of the pitch between the electrodes 30 of the front glass substrate to have the same pixel resolution in both directions of the panel. Note that the phosphor may be used as some or all of the dielectric layer, in which case the previously mentioned secondary emissive thin film may be applied over the phosphor.

With continuing reference to FIG. 2, it will be noted that the thickness of the front and back glass substrates 22 and 24 is broken away because the depth of the gas discharge troughs 38 and the corresponding height of the barrier ribs 40 is only on the order of magnitude of thousandths of an inch as compared to the much thicker substrates. For example, in one desired construction, the spacing pitch between the gas discharge troughs is four thousandths of an inch with each trough having a width of three thousandths of an inch, each barrier rib 40 having a width of one thousandth of an inch and a height of four thousandths of an inch. These exemplary dimensions are not intended to limit the invention, but rather to provide a general understanding of the relatively small dimensions involved. Also, it should be noted that the dielectric layer 44 and phosphors 48 are also very thin, e.g. a number of microns thick, but are shown thicker for ease of illustration.

Various other features and techniques which may be utilized with plasma display panel 20 are described in detail in copending U.S. patent application Ser. No. 08/933,905, filed on Sep. 23, 1997, naming James C. Rutherford as inventor, and entitled "System and Method for Driving a Plasma Display Panel", which is hereby incorporated by reference in its entirety.

In column discharge type plasma display panels, the column electrodes typically serve as the data electrodes and the row electrodes typically serve as the scan electrodes. During sustaining, accumulated wall charges are oscillated between the row and column electrodes to illuminate the display. In surface discharge type plasma display panels, the column electrodes typically serve as the data electrodes. There are typically two sets of row electrodes. The row scan electrodes are used for addressing. During sustaining, accumulated wall charges are oscillated between the row scan electrodes and corresponding row maintenance electrodes paired with the row scan electrodes as is well known in the art.

Embodiments of the present invention are not limited specifically to column electrodes. Plasma display driving techniques may attempt to use row or column electrodes in such a manner that a register controls the electrode states. Although one aspect of the present invention is its applicability to column electrodes, it may become desirable to employ embodiments of the present invention for scan, maintenance and/or data electrode drivers on the same display apparatus. However, to best illustrate the advantages of embodiments of the present invention, the following description is directed particular toward column data electrode driver circuits, which are also commonly referred to as data electrode driver circuits or addressing electrode driver circuits.

Column driver integrated circuit power consumption is largely displacement power which is a function of address voltage, electrode capacitance, and addressing frequency. Displacement power arises from repeatedly charging and discharging the capacitance of the column electrode through a resistive element, such as a transistor. Embodiments of the present invention reduce displacement power significantly, and in some instances, may allow reduction or elimination of expensive heat sinks for the driver chips.

Figure 3:
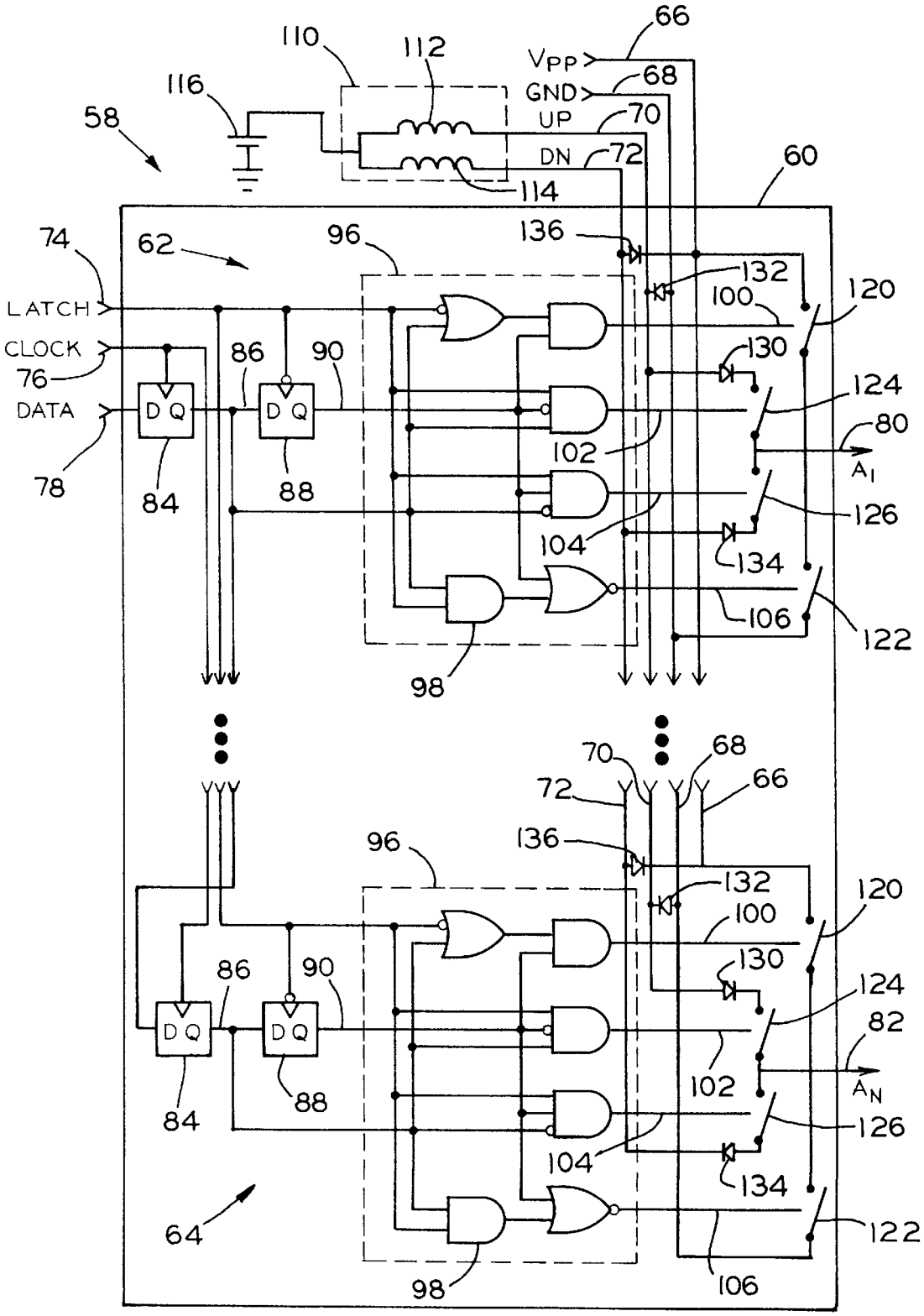
FIG. 3 is a system for driving a plasma display panel, shown as a display driver integrated circuit chip connected to driver circuitry in a first embodiment of the present invention.

With reference to FIG. 3, a system 58 for efficiently driving a flat panel display such as plasma display panel 20, is shown. The system 58 includes integrated circuit chip 60 for efficiently driving the column electrodes. Integrated circuit chip 60 is specifically designed for direct connection to the plasma display panel electrodes, typically in groups of 64 electrodes. Each electrode is driven by an associated column driver circuit of integrated circuit chip 60. As illustrated, a first column driver circuit 62 corresponds to electrode 80. A second column driver circuit 64 corresponds to electrode 82. Chip 60 includes a plurality of pins for connection to other plasma display panel circuitry. Pin 66 connects to a hold up voltage source of $V_{pp}$. Pin 68 connects to a hold down voltage source or ground, designated as GND. Pin 70 connects to the up driver circuitry, and is designated UP. Pin 72 connects to the down driver circuity, and is designated DN. Pin 74 and pin 76 connects to the LATCH signal and clock signal, respectively. Pin 78 receives the display data signals.

The driver circuit on chip 60 includes a register capable of storing display bits. The register is preferably a shift register capable of parallel output, and is formed by a plurality of cascaded D flip-flops 84. Each bit 86 represents a next state for a corresponding data electrode. A latch is connected to the register and is preferably formed of a plurality of D flip-flops 88 with a D flip-flop input connected to each register output bit 86. Latch outputs 90 represent a current state for corresponding data electrodes. It is to be appreciated that the latch is sometimes referred to as a holding register by those skilled in the art of display panels, and that the term latch as used herein is intended to encompass such holding registers. Further, the terms register and latch as used herein are intended to encompass other bistable device arrangements capable of performing as a register or as a latch.

A logic circuit 96 is preferably a combinational logic network made up of a plurality of gates 98. Logic circuit 96 has a first input connected to register bit 86, and a second input connected to corresponding latch output 90.

It is to be understood that all of the column driver circuits are substantially identical, and like reference numerals have been used to indicate like components among the column circuit drivers. To facilitate an understanding of the present invention, only column driver circuit 62 will be described.

Logic circuit 96 generates a plurality of control signals. A hold up control signal 100, a change up control signal 102, a change down control signal 104, and a hold down control signal 106, are each determined by logic circuit 96. As shown, the D flip-flops 88 forming the latch are triggered by the falling edge of the LATCH signal, as indicated by the dynamic indicator and the polarity indicator. Logic circuit 96 is a gated logic circuit, and is only active when LATCH is high. The rising edge of the LATCH signal is the beginning of the activation signal, and the falling edge of LATCH is the end of the activation signal which causes the state transition to occur.

As shown, logic circuit control signals 100, 102, 104, 106 operate in one hot code. While LATCH is low, either the hold up control signal 100 or the hold down control signal 106 is asserted. If the current state is high while LATCH is low, the hold up control signal 100 is asserted. If the current state is low, while LATCH is low, the hold down control signal 106 is asserted. When the LATCH signal is high, and the current and next states for the corresponding electrodes are both low, the hold down control signal 106 is asserted. When the current and next state are both high, and LATCH is high, the hold up control signal 100 is asserted. When LATCH is high, and the current and next state for the corresponding electrode are different, either the change up control signal 102 or the change down control signal 104 is asserted. When LATCH is high, the current state is low, and the next state is high, the change up control signal 102 is asserted. When LATCH is high, the current state is high, and the next state is low, the change down control signal 104 is asserted. It is to be appreciated that various alternative designs for logic circuit 96 may be made in accordance with the present invention.

For example, alternative to one hot code, the logic circuit 96 may be configured such that after the activation signal (when the activation signal is low), the hold up control signal 100 and the change up control signal 102 are asserted to connect the hold up voltage source and the change up driver to electrodes having a high current state. Further, the hold down control signal 106 and the change down control signal 104 are asserted to connect the hold down voltage source and the change down driver to electrodes having a low current state.

Figure 5:
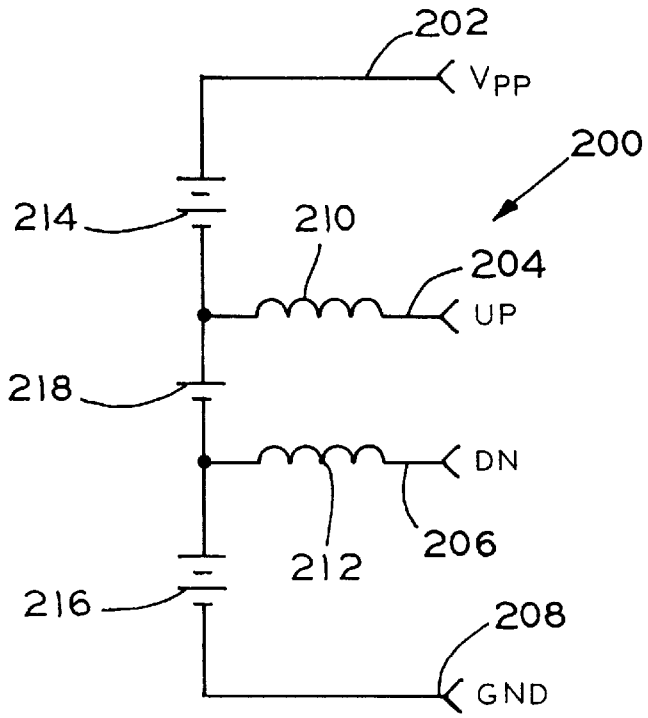
FIG. 5 illustrates driver circuitry similar to that of the system shown in FIG. 3, with a voltage source positioned between the change up and change down inductors to compensate for any losses.

The arrangement described immediately above is very advantageous when non-zero current is anticipated for any inductors in the driver circuitry when LATCH is pulled low, particularly in the driver circuitry of FIG. 3 or 5. Such an arrangement may be easily implemented, for example, with two additional OR type gates at the change up and down control signals of logic circuit 96.

The logic circuit asserts the control signals to selectively connect the hold up driver, hold down driver, change up driver, or change down driver to each electrode corresponding to each respective logic circuit 96. In the embodiment shown in FIG. 3, driver circuitry 110 includes a change up driver formed by first inductor 112, and a change down driver formed by second inductor 114. The first and second inductors 112 and 114, respectively, are connected to power source 116 for drawing current when necessary.

Hold up control signal 100 and hold down control signal 106 are connected to hold up switch 120 and hold down switch 122, respectively. Change up control signal 102 and change down control signal 104 are connected to change up switch 124 and change down switch 126, respectively. The switches may be implemented in any of a variety of ways known in the art, such as MOSFETs. Further, all switches need not be implemented in the same manner. For example, a first type of switch device may be employed for the hold drivers, and a second type of switch for the change drivers. The logic circuit control signals 100, 102, 104, 106 are connected to the switch inputs. Hold up switch 120 has a terminal connected to $V_{pp}$ source pin 66, and another terminal connected to data electrode 80. Hold down switch 122 has a terminal connected to ground pin 68, and another terminal connected to data electrode 80. Change up switch 124 has a terminal connected to data electrode 80, and another terminal connected to the cathode of diode 130. The anode of diode 130 is connected to up driver pin 70. Diode 130 prevents current from leaking into the change up driver, and from leaking into other outputs. Another diode 132 has an anode connected to ground pin 68 and a cathode connected to up driver pin 70 to prevent up driver pin 70 from becoming excessively low in voltage; still another diode may be connected so as to prevent up driver pin 70 from becoming excessively high in voltage. Change down driver switch 126 has a terminal connected to data electrode 80, and another terminal connected to the anode of diode 134. The cathode of diode 134 is connected to down driver pin 72. Diode 134 prevents current from leaking from the change down driver, and from leaking into other outputs. Another diode 136 has a cathode connected to $V_{pp}$ source pin 66 and an anode connected to down driver pin 72 to prevent down driver pin 72 from becoming excessively high in voltage; still another diode may be connected so as to prevent down driver pin 72 from becoming excessively low in voltage.

During use of chip 60 in a plasma display panel, data at data pin 78 is clocked into the shift register consisting of D flip-flops 84. Clock pin 76 is oscillated to enter the display data into the register, while LATCH is held low. LATCH is then pulled from low to high to activate logic circuit 96, allowing logic circuit 96 to generate any one of the following outputs based on the current and next states: "hold up", "hold down", "change up", or "change down". The appropriate control signal of logic circuit 96 is then asserted, until LATCH is pulled low again to restrict the output of logic circuit 96 to either "hold up" or "hold down". As will be further described in the description of circuit voltage waveforms, the pulse width of the LATCH pulse is preferably coordinated with the electrode capacitance, number of electrodes in the group driven by chip 60, and the parameters of the driver circuit such as driver circuit inductance in the inductor embodiment shown in FIG. 3.

Figure 4A:
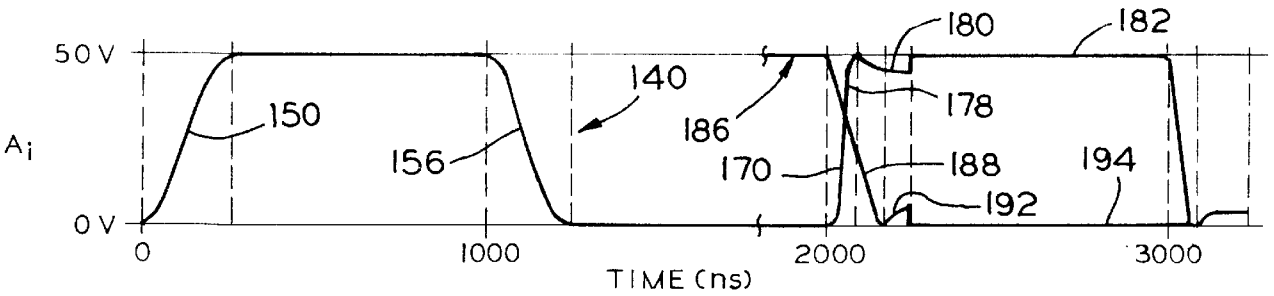
FIG. 4*a* is a graph depicting voltage waveforms for data electrodes in the first embodiment of the present invention.
Figure 4B:
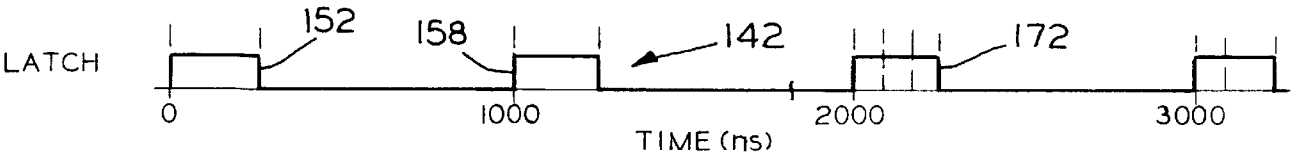
FIG. 4*b* is a graph depicting a voltage waveform for the latch in the first embodiment of the present invention.
Figure 4C:
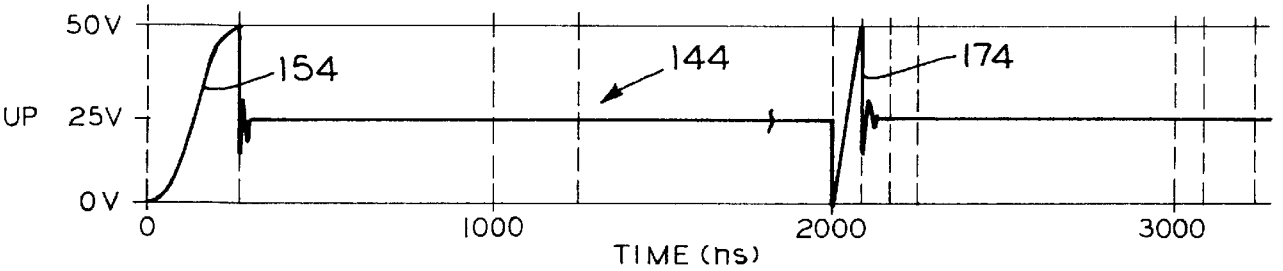
FIG. 4*c* is a graph depicting a voltage waveform for the change up inductor in the first embodiment of the present invention.
Figure 4D:
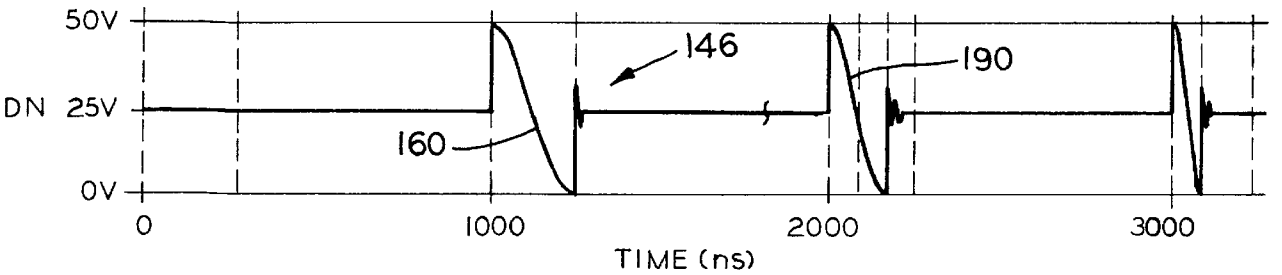
FIG. 4*d* is a graph depicting a voltage waveform for the change down inductor in the first embodiment of the present invention.

With reference to FIGS. 4*a*–4*d*, voltage waveforms for a first embodiment of the change up and change down driver circuitry which uses first and second inductors 112 and 114 (FIG. 3) respectively, are shown. The data electrode driving waveform is shown in FIG. 4*a* and is indicated at 140. The LATCH driving waveform is shown in FIG. 4*b* and is indicated at 142. The up recover waveform as measured at up driver pin 70 (FIG. 3) is best shown in FIG. 4*c* and indicated at 144. The down recover waveform as measured at down driver pin 72 (FIG. 3) is best shown in FIG. 4*d* and indicated at 146.

To facilitate an understanding of the first embodiment of the change up and change down driver circuitry, the graphs depicted in FIGS. 4*a*–4*d* all have a common temporal scale with dashed lines marking the boundaries of charging and discharging intervals. With reference to FIGS. 3 and 4*a*–4*d*, at 0 nanoseconds, LATCH is pulled high to activate gated logic circuit 96, at pulse 152 (FIG. 4*b*). Because the electrode current state is low or logic '0' and the next state is high or logic '1' for all electrodes, change up control signal 102 is asserted for all electrodes. Switch 124 is then activated by the voltage at its input from change up control signal 102. Up driver pin 70 is immediately pulled down to 0 volts, as best shown in FIG. 4*c*. The current in inductor 112 increases as up driver pin 70 rises toward 25 volts. When up driver pin 70 reaches 25 volts, the current through inductor 112 will be at its maximum. The current through inductor 112 then decreases as the voltage at up driver pin 70 approaches 50 volts. When up driver pin 70 reaches 50 volts, LATCH is pulled low, turning off switch 124, and the charging of electrode 80 and the other electrodes is complete. The charging of electrode 80 and the others is best shown in FIG. 4*a* at wave portion 150. The voltage of up driver pin 70 is best show at wave portion 154 in FIG. 4*c*. It is to be appreciated that while charging electrode 80, the voltage drop across closed switch 124 is substantially minimized to reduce driver chip power consumption. In the embodiment illustrated, the LATCH pulse is about 250 nanoseconds, and each address voltage pulse is about 1 microsecond.

As depicted in FIGS. 4*a*–4*d*, the voltage waveforms between 0 nanoseconds and 250 nanoseconds represent the simultaneous charging of all data electrodes in the electrode group driven by driver chip 60. The inductance value for inductor 112 is s elected based on the number of electrodes in the group, electrode capacitance, and the desired charging time for the entire group of electrodes when all of the electrodes in the group are to be charged.

The LATCH signal ideally has a pulse width equal to the time required to simultaneously charge all electrodes of the group, as best shown in the 0 to 250 nanosecond interval in FIGS. 4*a*–4*d*.

In the interval from 1000 nanoseconds to 1250 nanoseconds, the simultaneous discharging of all electrodes of the group driven by driver chip 60 is depicted. Data electrode 80, and all other data electrodes discharge at wave portion 156 of waveform 140 in FIG. 4*a*. LATCH pulse 158 (FIG. 4*b*) causes the down driver pin 72 to behave as shown at portion 160 of waveform 146 in FIG. 4*d*. The discharging occurring in the interval from 1000 nanoseconds to 1250 nanoseconds is similar to the charging of the electrode group in the interval from 0 to 250 nanoseconds. When discharging, LATCH pulse 158 activates gated logic circuit 96 which asserts change down control signal 104 to turn on switch 126 for all electrodes. Inductor 114 preferably has the same inductance value as inductor 112; however, a different inductance value may be chosen for inductor 114 if, for example, the discharging time desired for all electrodes of the group is different than the charging time desired for all electrodes of the group.

With continuing reference to FIGS. 3 and 4*a*–4*d*, the substantially simultaneous charging of some electrodes and discharging of other electrodes, all of which are in the group of electrodes controlled by driver circuit chip 60, is illustrated. In the time interval from 2000 nanoseconds to 2250 nanoseconds, the substantially simultaneous charging and discharging is depicted. Data electrode wave portion 170 of waveform 140, shown in FIG. 4*a*, shows the charging of some of the electrodes of the electrode group upon LATCH pulse 172 (FIG. 4*b*). Up driver pin 70 behaves as shown at wave portion 174 of waveform 144 shown in FIG. 4*c*. Because only some of the electrodes are being charged, the capacitive load at the output of change up switch 124 is less than the maximum load. Hence, the resonant frequency at up driver pin 170 is higher, and as illustrated, the charging time for the electrodes is shorter. As shown in FIG. 4*a*, the data electrodes are fully charged before the end of LATCH pulse 172. Wave portion 180 of data electrode waveform 140 illustrates partial discharging of the electrodes while change up switch 124 remains on. Diode 130 limits the leakage currents to minimize lost charge. After LATCH pulse 172, hold up driver control signal 100 is asserted, turning on hold up switch 120. Wave portion 182 of waveform 140 in FIG. 4*a* depicts the completion of electrode charging, which occurs through hold up switch 120.

Other electrodes in the electrode group driven by driver chip 60 are discharged. The charging and discharging of different electrodes in the same electrode group is preferably performed substantially simultaneously. Preferably, both charging and discharging are simultaneously initiated upon the rising edge of the LATCH pulse. However, delay may be added to the starting of either charging or discharging, as desired.

The other electrodes of the group, which are being discharged, have voltage waveforms 186 illustrated in FIG. 4*a*. Wave portion 188 shows the voltage on the discharge electrodes. Wave portion 190 of waveform 146 (FIG. 4*d*) for down driver pin 72, illustrates electrode discharging through the inductor. Data electrode voltage waveform 186, after descending to 0 volts, before the end of LATCH pulse 172, undergoes slight charging at wave portion 192 due to leakage current through diode 134. As shown in wave portion 194 of waveform 186 (FIG. 4*a*), the hold down driver quickly pulls the discharged electrodes to zero volts upon the end of the latch pulse 172.

Another discharge of several electrodes of the group of electrodes driven by driver chip 60 occurs at 3000 nanoseconds. This discharge occurs in the same manner as those previously described. It is to be appreciated that the substantially simultaneous charging and discharging of electrodes in the same group induces current in both first inductor 112 and second inductor 114. The discharge current through inductor 114 may then be drawn through inductor 112 to charge any electrodes being charged. By efficiently routing current through the pair of inductors, current draw from source 116 is substantially minimized, and the average current draw from source 116 is zero. Alternatively, source 116 may be a large capacitor.

Embodiments of the present invention are advantageous because the voltage drop across the change up and change down switches is substantially reduced with techniques so efficient that the techniques may be employed in panel addressing. The voltage reduction across the change up and change down switches causes the chip 60 to dissipate less energy; hence, chip operation is cooler. Further, embodiments of the present invention are advantageous because current draw from the power source for charging and discharging may be minimized, if desired.

Alternatively, inductors 112 and 114 may be configured such that the inductance of each is variable to match the loading conditions. For example, each driver may comprise a series of inductors, with the individual inductors configured in the circuit so that individual inductors may be switched out of the circuit to vary inductance. Such a circuit would allow the inductances of the up driver circuitry and the down driver circuitry to be individually, dynamically, matched to the capacitive load, as desired. As a result, the change up and change down times could be made to always match a given LATCH pulse width.

The potential for reducing power dissipation within chip 60 is so significant that, compared to the same integrated circuit silicon area used in prior driver chips, the driver schemes of the present invention are expected to require much less area for output function devices (for the same number of outputs). This allows considerably more area for input and/or additional output function silicon. Therefore, more functionality may be added to each integrated circuit chip, because the power efficiency allows more functionality to be achieved in the same chip area. For this reason, embodiments of the present invention are significantly applicable to plasma display panel column drivers as well as row drivers, and both row and column drivers for electroluminescent displays, liquid crystal displays, and field emissive displays.

With reference to FIG. 5, a preferred implementation of the first embodiment of the present invention is generally indicated at 200. Driver circuitry 200 includes a $V_{pp}$ connection 202 for connecting to a high voltage source, an up driver connection 204 for connecting to up driver pin 70, a down driver connection 206 for connecting to down driver pin 72, and a ground connection 208 for connecting to a low voltage source or ground. First and second inductors 210 and 212, respectively, limit the voltage drop across change up switch 124 and change down switch 126. A pair of main voltage sources 214 and 216 are, for example, each about 22.5 volts. A supplemental voltage source 216 is, for example, about 5 volts. Supplemental voltage source 216 provides a voltage difference between inductors 210 and 212 to compensate for any losses including diode drops.

Figure 6:
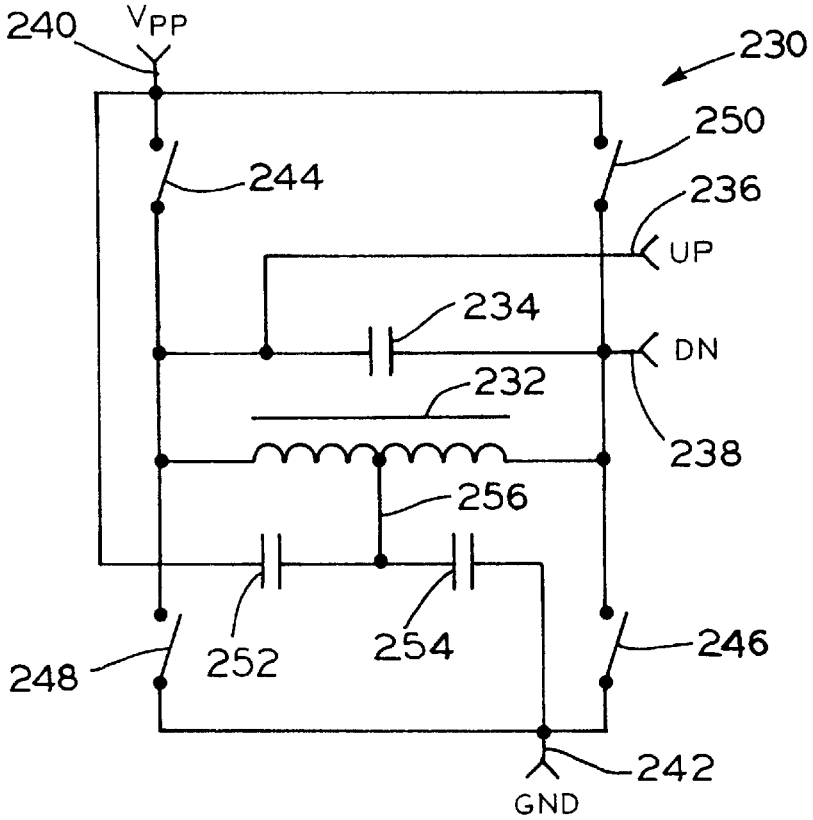
FIG. 6 illustrates driver circuitry in a second embodiment of the present invention.

With reference to FIG. 6, a second embodiment of driver circuitry is generally indicated at 230. An oscillator circuit is formed by ferromagnetic core inductor 232 and capacitor 234. Up driver connection 236 is connected to one side of the oscillator, while down driver connection 238 is connected to the other side of the oscillator. The circuit 230 also has a $V_{pp}$ connection 240 for connecting to a high voltage source, and a ground connection 242 for connecting to a low voltage source or ground. A first switch 244 and a second switch 246 may be simultaneously asserted when the oscillator circuit is at an appropriate peak voltage to supply additional energy to the oscillator circuit which compensates for any resistive losses. Further, a third switch 248 and a fourth switch 250 may be simultaneously asserted when the oscillator is at its opposite peak to compensate for any resistive losses.

Figure 7A:
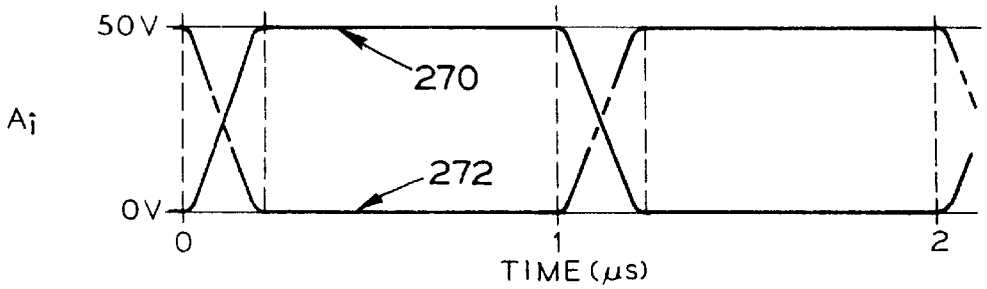
FIG. 7*a* is a graph depicting voltage waveforms data electrodes in the second embodiment of the present invention.
Figure 7B:
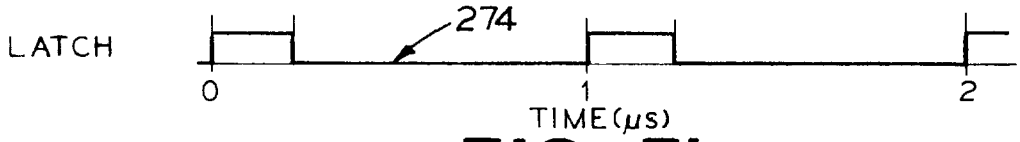
FIG. 7*b* is a graph depicting a voltage waveform for the latch in the second embodiment of the present invention.
Figure 7C:
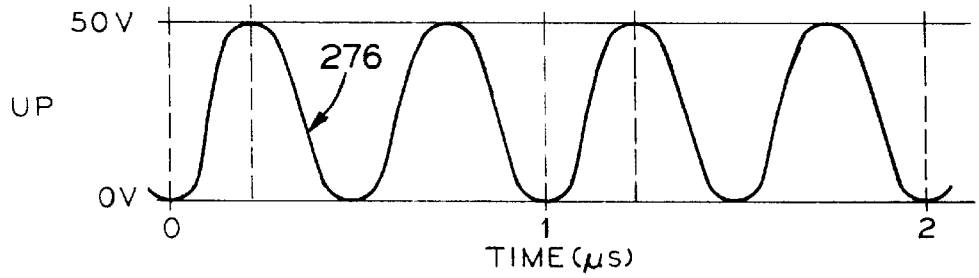
FIG. 7*c* is a graph depicting the change up voltage waveform in the second embodiment of the present invention.
Figure 7D:
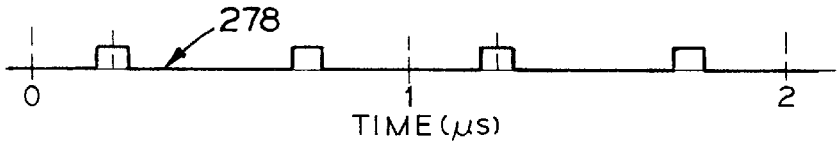
FIG. 7*d* is a graph depicting a voltage waveform for controlling a first pair of switches to drive the oscillator shown in FIG. 6.
Figure 7E:
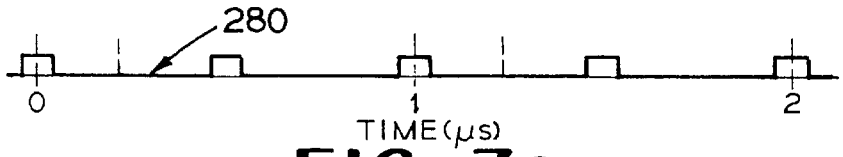
FIG. 7*e* is a graph depicting a voltage waveform for controlling a second pair of switches to drive the oscillator shown in FIG. 6.
Figure 7F:
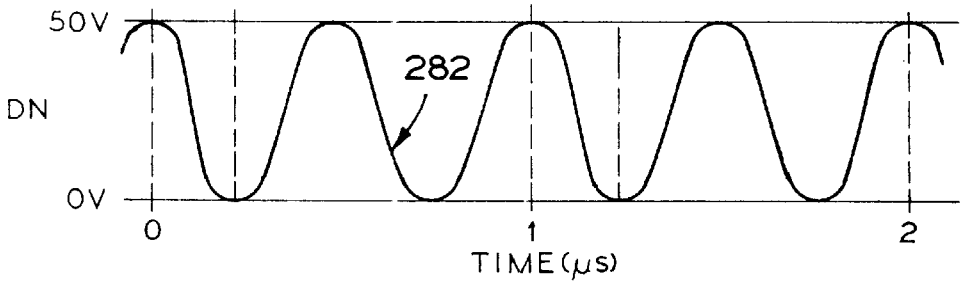
FIG. 7*f* is a graph depicting the change down voltage waveform in the second embodiment of the present invention.

With reference to FIGS. 7*a*–7*f*, voltage waveforms for the oscillator type driver circuitry embodiment (FIG. 6) are shown. The electrode waveforms are shown in FIG. 7*a*. Waveform 270 illustrates some of the electrodes, while waveform 272 illustrates others of the electrodes. The LATCH waveform is shown in FIG. 7*b*, and is indicated at 274. The waveform for up driver connection 236 is shown in FIG. 7*c*, and is indicated at 276. The waveform for down driver connection 238 is shown in FIG. 7*f*, and is indicated at 282. First and second switches 244 and 246 are driven with the waveform shown in FIG. 7*d*, indicated at 278. Third and fourth switches 248 and 250 are driven with the waveform shown in FIG. 7*e*, indicated at 280.

It is to be appreciated that the free running oscillator circuit, when synchronized correctly with the LATCH signal, reduces the voltage drop across the change up and change down switches. This results in a driver chip with minimal power dissipation in the change up and change down switches.

As best shown in FIG. 6, a center tap 256 is separated from $V_{pp}$ connection 240 by a capacitor 252, and from GND connection 242 by a capacitor 254. Centertap 256 stabilizes the oscillator.

It is to be appreciated that a variety of driver circuits may be employed to reduce the voltage drop across the change up and change down switches, thereby reducing chip power consumption, based on the display data in the shift register (next state) and at the latch output or holding register (current state). Further, embodiments of the present invention may be employed to reduce total display power consumption. The inductor embodiments shown in FIGS. 3 and 5, and the oscillator embodiment shown in FIG. 6, are merely illustrative configurations of the present invention which controls electrode connection to voltage driver circuits based on next and current electrode states.

With reference to FIGS. 8*a*–8*d*, alternative waveforms for the electrodes, latch, change up connection, and change down connection are shown. The data electrode resulting voltage waveforms are indicated at 290 and 292. Waves 290 and 292 have opposite phases to illustrate simultaneous charging and discharging which is preferred, but not required. Simultaneous or substantially simultaneous charging and discharging facilitates $V_{pp}$ source current draw minimizing in addition to efficient electrode driving within the driver chip. Simultaneous charging and discharging is preferred to maximize the data valid time for the data electrodes.

Figure 8A:
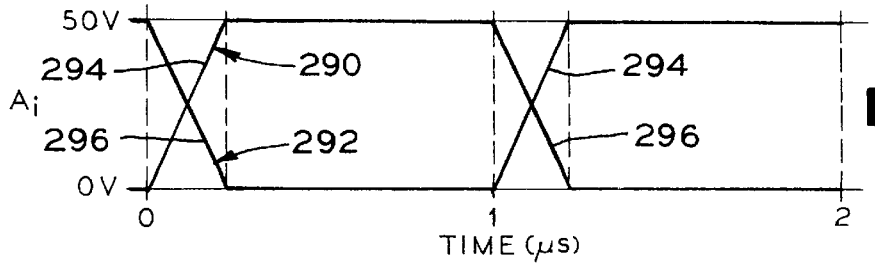
FIG. 8*a* is a graph depicting voltage waveforms for data electrodes in a third embodiment of the present invention.
Figure 8B:
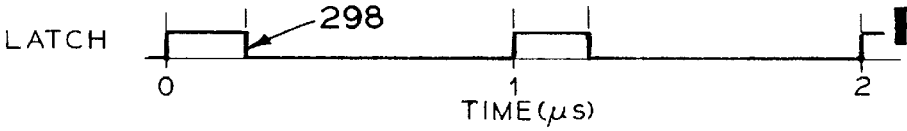
FIG. 8*b* is a graph depicting a voltage waveform for the latch in the third embodiment of the present invention.
Figure 8C:
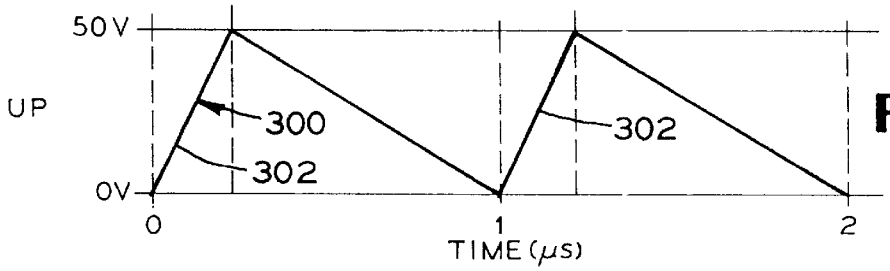
FIG. 8*c* is a graph depicting the change up voltage waveform in the third embodiment of the present invention.
Figure 8D:
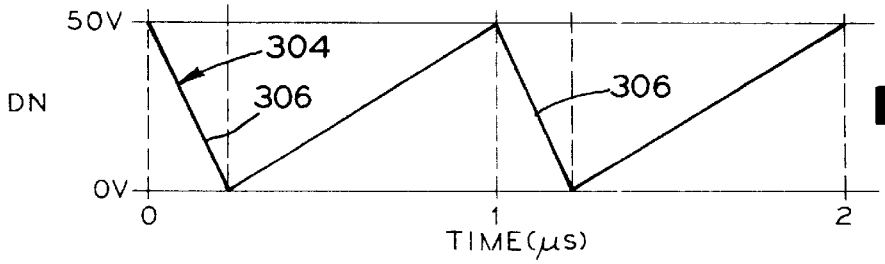
FIG. 8*d* is a graph depicting the change down voltage waveform in the third embodiment of the present invention.

Electrode waveforms 290 and 292 have charging portions 294, and discharging portions 296. Latch waveform 298 is shown in FIG. 8*b*, and has a pulse width which corresponds to the charging and discharging times for the electrodes. The change up driver waveform 300, in FIG. 8*c*, has charging portions 302 which correspond to charging portions 294 of the electrode waveforms in FIG. 8*a*. The change down driver waveform 304, in FIG. 8*d*, has discharging portions 306 which correspond to discharging portions 296 of the electrode waveforms in FIG. 8*a*. It is to be appreciated that the ramp change up and ramp change down driver waveforms shown in FIGS. 8*c*–8*d* provide the maximum power dissipation reduction in the resistive switching components, due to the second-order nature of power dissipated. The waveforms shown in FIGS. 8*a*–8*d* may be generated by a number of common function generator circuits known to those of ordinary skill in the art.

Figure 9:
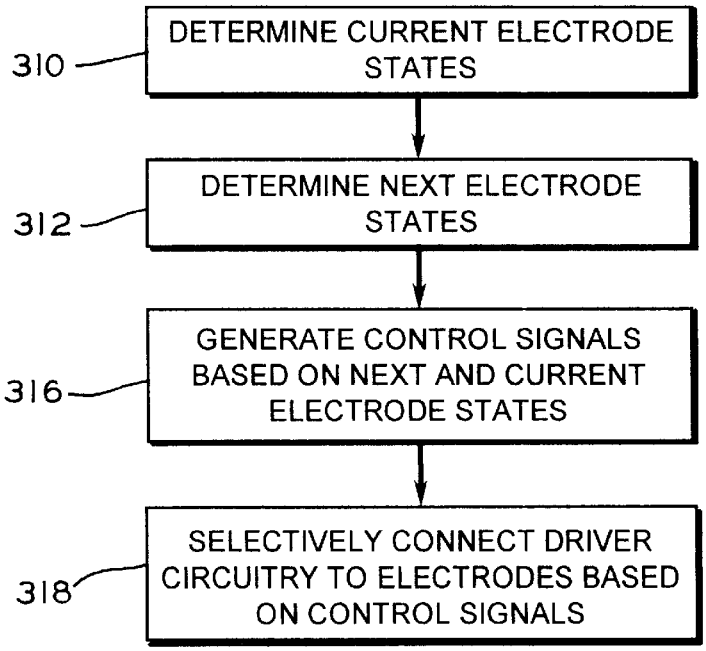
FIG. 9 is a block diagram illustrating a method of the present invention for driving a flat panel display, such as the plasma display panel shown in FIGS. 1 and 2.

With reference to FIG. 9, a method of the present invention for driving a flat panel display will now be described. Methods of the present invention are particularly well suited for data electrode driving; however, embodiments of the present invention may be employed in scanning or sustaining electrodes, if desired, where appropriate. At block 310, the current states are determined for all electrodes in a group of electrodes, such as a group of electrodes all driven by a single driver chip. At block 312, the next states are determined for all electrodes of the electrode group. At block 316, control signals are generated based on the current and next state of each electrode. The control signals may indicate any of the following conditions: "hold up", "hold down", "change up", "change down", of which "hold up" and "change up", or "hold down" and "change down" may be asserted simultaneously as described previously. Other conditions for driving the electrodes may be indicated by the control signals, such as "float" or "no driver", if desired for the particular configuration. At block 318, each electrode of the group is selectively connected to the appropriate driver circuitry based on the control signals, and preferably the activation signal.

Further, other functions and/or structures may be implemented on the chip such as polarity and on-chip memory due to the cooler chip operation resulting from the present invention. Designs of the present invention may allow memory arrays and interface logic to be incorporated as front end functions of the driver chips. Still further, it is to be appreciated that embodiments of the present invention may be implemented on dielectric isolated wafers, such as silicon on insulator (SOI) technologies.

While the best mode for carrying out the invention has been described in detail, those familiar with the art to which this invention relates will recognize various alternative designs and embodiments for practicing the invention as defined by the following claims.

What is claimed is:

1. A plasma display panel including a pair of substrates positioned to define a gap region therebetween, and electrodes disposed in the gap region to form display lines composed of pixels, the electrodes including a group of electrodes, the plasma display panel further comprising:

a register capable of storing display bits, each bit representing a next state for a corresponding electrode;

latch connected to the register and having outputs, each output representing a current state for a corresponding electrode;

logic circuits corresponding to the electrodes, each logic circuit generating a plurality of control signals based on the next state and the current state of the corresponding electrode, the plurality of control signals including a change up control signal, a change down control signal, a hold up control signal, and a hold down control signal; and driver circuitry including a change up driver, a change down driver, a hold up voltage source, and a hold down voltage source, each electrode being selectively connectable to the driver circuitry by the corresponding logic circuit control signals, wherein each logic circuit is configured such that upon an activation signal, the logic circuit asserts the change up control signal to connect the change up driver to electrodes having a low current state and a high next state, asserts the change down control signal to connect the change down driver to electrodes having a high current state and a low next state, asserts the hold up control signal to connect the hold up voltage source to electrodes having a high current state and a high next state, and asserts the hold down control signal to connect the hold down voltage source to electrodes having a low current state and a low next state.

2. The plasma display panel of claim 1 wherein the logic circuit is configured such that after the activation signal, the hold up control signal and the change up control signal are asserted to connect the hold up voltage source and the change up driver to electrodes having a high current state, and the hold down control signal and the change down control signal are asserted to connect the hold down voltage source and the change down driver to electrodes having a low current state.

3. A method of driving a flat panel display, the flat panel display including a group of electrodes, the method comprising:

determining a current state for each electrode of the group of electrodes;

determining a next state for each electrode of the group of electrodes;

generating at least one control signal for each electrode based on the next state and the current state for that electrode; and selectively connecting driver circuitry to each electrode based on the at least one control signal for that electrode, such that electrodes having a low current state and a high next state are connected to a change up driver and electrodes having a high current state and a low next state are connected to a change down driver.

4. A system for driving a flat panel display having a predetermined number of scan electrodes and a predetermined number of data electrodes, the system comprising:

driver circuitry including a change-up driver, a change-down drive, and an oscillator, wherein the oscillator provides a first voltage waveform corresponding to the change-up driver and a second voltage waveform corresponding to the change-down driver; and logic circuits generating control signals for selectively connecting each data electrode to the driver circuitry based on the next state and the current state of the data electrode, wherein the logic circuits are configured such that upon an activation signal, the logic circuit control signals connect the change up driver to data electrodes having a low current state and a high next state and the change down driver to data electrodes having a high current state and a low next state.

5. The system for driving a flat panel display defined in claim 4 wherein the first and second voltage waveforms have opposite phases.

6. The system for driving a flat panel display defined in claim 4 wherein the driver circuitry provides a change-up driver, a change down driver, a hold-up driver and a hold-down driver.

* * * * *